US010119274B2

(12) United States Patent
Braun

(10) Patent No.: US 10,119,274 B2
(45) Date of Patent: Nov. 6, 2018

(54) BRIDGING DEVICE

(71) Applicant: MAURER SÖHNE ENGINEERING GMBH & CO. KG, München (DE)

(72) Inventor: Christian Braun, Holzkirchen (DE)

(73) Assignee: MAURER SÖHNE ENGINEERING GMBH & CO. KG, München (DE)

( * ) Notice: Subject to any disclaimer, the term of this patent is extended or adjusted under 35 U.S.C. 154(b) by 0 days.

(21) Appl. No.: 15/038,372

(22) PCT Filed: Nov. 27, 2014

(86) PCT No.: PCT/EP2014/075856
§ 371 (c)(1),
(2) Date: May 20, 2016

(87) PCT Pub. No.: WO2015/078991
PCT Pub. Date: Jun. 4, 2015

(65) Prior Publication Data

US 2016/0289967 A1 Oct. 6, 2016

(30) Foreign Application Priority Data

Nov. 28, 2013 (DE) ..... 10 2013 224 460

(51) Int. Cl.
*E04C 3/02* (2006.01)
*E01D 19/06* (2006.01)
(Continued)

(52) U.S. Cl.
CPC ..... *E04C 3/02* (2013.01); *E01D 19/062* (2013.01); *E04C 3/005* (2013.01); *E04C 3/30* (2013.01); *E04C 2003/026* (2013.01)

(58) Field of Classification Search
CPC ..... E01D 19/06; E01D 19/062; E01D 19/065; E04C 3/005; E04C 3/02; E04C 3/30; E04C 2003/026
(Continued)

(56) References Cited

U.S. PATENT DOCUMENTS 1,523,711 A * 1/1925 Powell ..... E04C 3/02 52/695
2,316,233 A 4/1943 Fischer
(Continued)

FOREIGN PATENT DOCUMENTS

DE 22 08 680 A1 10/1973
DE 27 46 490 A1 4/1979
(Continued)

OTHER PUBLICATIONS

European Search Report issued in European Patent Application No. 14 806 587.3 dated Jun. 30, 2017.
(Continued)

*Primary Examiner* — Charles A Fox
*Assistant Examiner* — Joseph J. Sadlon
(74) *Attorney, Agent, or Firm* — Baker & Hostetler LLP

(57) ABSTRACT

A bridging device in center girder construction for a building joint between two building components having at least two edge girders and at least one center girder arranged between the edge girders and on at least one cross member bridging the building joint that each have a cross member bearing for bearing the cross member on the respective building components at their lateral ends. The object of the present invention is to provide a novel bridging device that is formed in particular space-saving. The initially described bridging device has a cross member having at least two cross member segments arranged along a longitudinal axis of the cross member and arranged displaceable relative to each other
(Continued)

toward the longitudinal axis, so the length of the cross member is variable.

24 Claims, 11 Drawing Sheets

(51) Int. Cl.
*E04C 3/30* (2006.01)
*E04C 3/00* (2006.01)

(58) Field of Classification Search
USPC ..... 14/73.1, 73.5; 52/167.6, 693
See application file for complete search history.

(56) References Cited

U.S. PATENT DOCUMENTS 3,090,215 A * 5/1963 Rosen ..... D04B 15/38 66/132 R
3,102,306 A * 9/1963 Hutchinson ..... E04C 3/02 29/897.3
3,324,774 A * 6/1967 Boschi ..... E01D 19/06 404/47
3,520,236 A * 7/1970 Sequaris ..... E01D 19/06 14/73.1
3,732,021 A 5/1973 Rizza et al.
3,880,540 A * 4/1975 Rizza ..... E01D 19/062 404/69
3,904,302 A * 9/1975 Bertschmann ..... E01D 19/062 404/68
4,030,156 A * 6/1977 Raymond ..... E01D 19/062 14/73.1
4,050,207 A * 9/1977 Bertschmann ..... E01D 19/06 404/68
4,087,191 A * 5/1978 Brady ..... E01D 19/062 14/73.1
4,120,066 A * 10/1978 Leroux ..... E01D 19/06 14/73.1
4,564,967 A * 1/1986 Vidal ..... E02D 29/0241 14/75
4,634,133 A * 1/1987 Wercholoz ..... E01D 19/06 277/642
4,963,056 A * 10/1990 Cihal ..... E01D 19/06 14/73.1
5,125,763 A * 6/1992 Seantier ..... E01C 11/126 14/73.1
5,197,250 A * 3/1993 Kramer ..... E01C 11/10 404/65
5,302,050 A * 4/1994 Buckenauer ..... E01D 19/062 14/62
5,349,712 A * 9/1994 Kawashima ..... E04H 9/02 14/73.5
5,537,790 A * 7/1996 Jackson ..... E04H 9/021 14/73.1
6,039,503 A * 3/2000 Cathey ..... E01C 11/10 14/73.1
6,520,706 B1 * 2/2003 McKague, Jr. ..... B29C 70/342 403/265
6,931,807 B2 * 8/2005 Braun ..... E01D 19/062 404/47
7,395,570 B2 * 7/2008 Bradford ..... E01D 19/062 14/73.1
8,387,339 B2 * 3/2013 Birch ..... E04B 2/827 52/243.1
9,051,729 B2 * 6/2015 Mead ..... E05B 65/006
2008/0172808 A1 * 7/2008 England ..... E01D 19/06 14/3
2011/0308174 A1 * 12/2011 Meyer ..... E04C 3/005 52/111

FOREIGN PATENT DOCUMENTS

DE 4303268 A1 * 8/1994 ..... E01D 19/062
DE 102 22 690 A1 11/2003
DE 10 2011 050977 A1 12/2012
RU 110 759 U1 11/2011
WO 2012/168476 A1 12/2012

OTHER PUBLICATIONS

Ukrainian Office Action issued in Ukranian Patent Application No. 2016 06787 dated Sep. 4, 2017.

* cited by examiner

BRIDGING DEVICE

CROSS-REFERENCE TO RELATED APPLICATIONS

This application is a National Stage of International patent application PCT/EP2014/075856, filed on Nov. 27, 2014, which claims priority to foreign German patent application No. DE 10 2013 224 460.6, filed on Nov. 28, 2013, the disclosures of which are incorporated by reference in their entirety.

FIELD OF THE INVENTION

The invention relates to a bridging device in center girder construction for a building joint between two building components having at least two edge girders and at least one center girder that is arranged between the edge girders and on at least one cross member bridging the building joint that each have a cross member bearing for bearing the cross member on the respective building components at their lateral ends.

BACKGROUND

In general, such devices are used to bridge building joints between two building components, in particular between two bridge parts such as for example a bridge-head or abutment, respectively, and a bridge bearing or bridge girder, respectively, or adjoining bridge girders such that vehicles and living beings from one member can safely reach the other member. The building joints also referred to as movement joints or expansion joints are for compensating motions of the building components relative to each other.

Bridging devices are known from the prior art in various embodiments. One customary form of a bridging device is that known as center girder construction or lamellar construction. Here, the bridging device has at least one center girder that is fixedly or slidably arranged on at least one cross member that is rotatably and/or displaceably supported on the adjoining building components.

In order to obtain uniform distances between individual center girders to each other and optionally to the edge girders and to prevent wandering of the center girders, so-called control devices are employed. For example, such control devices are formed by elastic chains, scissors or also by means of so-called pivoting cross members.

To take account of the motion of the building components in conventional cross members there are often arranged receiving areas on the building into which the cross members can partially be inserted. These receiving areas are also referred to as cross member boxes. The shape of these receiving areas depends on the expected motion and accordingly can be very large.

According to the structural circumstances the provision of cross member boxes may be very difficult up to virtually impossible. For example, with steel bridges the carriageway slab generally ends with an end cross girder that must not be broken through. If such a bridge not even in planning is designed such that sufficient space for the cross member box is provided sometimes retrofitting a cross member box is virtually impossible. So, especially in modernization the particularly advantageous bridging devices in center girder or lamellar construction cannot be employed at all.

SUMMARY OF THE INVENTION

Against this background it is the object of the present invention to provide a novel bridging device that is formed particularly space-saving and at the same time can be arranged particularly easily and directly between adjoining building components or building joints, respectively.

The problem is solved in that the initially described bridging device has a cross member with at least two cross member segments that are arranged along a longitudinal axis of the cross member and that are arranged displaceable relative to each other toward the longitudinal axis, so that the length of the cross member is variable. Thus, the bridging device according to the invention is retractable and extendable. Hereby, a cross member variable in length is provided whereby motions of the building components relative to each other can be considered in a particularly space-saving manner. Since the cross member according to the invention itself is variable in length now no separate receiving areas for inserting the cross member have to be provided on the building components.

Up to now, there have only been the conventional one-piece cross members and a multi-part cross member variable in length along the lines of telescopic arms, as used e.g. in cranes, has not been suggested, since such a structure raises problems with bridging devices. Telescopic arms have segments that are often formed as rectangular telescoping tubes. The circumferential surfaces of the segments are not aligned with each other, but have a height offset that often corresponds to the material thickness of the segments.

By the offset of the circumferential surfaces a center girder arranged thereon cannot simply change from one segment to another and back. It should be possible for the center girder(s) of a bridging device in center girder construction to be uniformly arranged or displaced along the entire length of the cross member or the bridging device in order to consider motions of the building joint. Also, by said offset it is not readily possible to arrange the upper surfaces of the center girders flush with each other or at the same height on the various segments such that the upper surfaces are aligned with each other as well as with the upper surfaces of the edge girders and the building components, e.g. carriageways. In known systems the load transfer is done with telescopic arms substantially at the end. A load transfer of large transverse forces transversely to the longitudinal extension of the telescopic arm beyond the individual overlapping segments, as it would occur with bridging devices in center girder construction, has not been tested so far.

Suitably, at least one cross member segment is formed as a guiding segment and one cross member segment is formed as a rodding segment, wherein the guiding segment guides the rodding segment at least toward the longitudinal axis of the cross member. In this way, the rodding segment can be supported by the guiding segment.

For a particularly robust and exact guide the guiding segment according to one development at least in sections is formed as a tube in which the rodding segment is supported such to be at least partially displaceable into the same. For example, said tube can have a rectangular or otherwise angular circumferential surface, so that the rodding segment can be arranged inside the tube in a torsionally stiff manner.

For a torsionally stiff guide the guiding segment in a further development has at least one tongue that extends in parallel to the longitudinal axis of the cross member and that engages a groove in the rodding segment, or vice versa. By the groove and the tongue it is advantageously also possible to compensate for an offset with the circumferential surfaces of the cross member segments, so that the surfaces of the cross member segments are oriented at least partially flushing with each other. In this way, it is possible to easily arrange center girders at the same height on the various cross member segments and at the same time move them back and forth between the various cross member segments.

In a further development, the guiding segment in the plan view is formed as a U-shaped clamp or an H-shaped double clamp that at least partially laterally encloses the rodding segment and at least holds it transversally to the longitudinal axis of the cross member. Said design has the advantage that the rodding segment is not enclosed at the upper surface by the guiding segment and thus, has an accessible exposed area at which a center girder can be arranged independent of the relative position of the rodding segment to the guiding segment.

The rodding segment can be formed corresponding to the guiding segment in order to allow a suitable bearing that is substantially free from play.

In a further development the rodding segment at least in sections is formed as a massive and/or hollow girder, in particular as T girder, double T girder, and/or as a box section tubing. Such girder forms have proved useful for bending stresses.

For bridging larger building joints in a further development at least two center girders are arranged in the bridging device, wherein the upper surfaces of the center girders are oriented flush with each other. Suitably, the upper surfaces of the center girders can also be formed flush with the upper surfaces of the edge girders and the upper surfaces of the building components. In this way it is ensured that the bridging device spans a plane on which the vehicles or living beings can safely pass the building gap.

In a further development the center girder(s) is/are arranged on a guiding segment and/or a rodding segment of the cross member. According to the first alternative the center girder(s) can be arranged along the entire length of the cross member. In this way, a uniform distribution of several center girders on the cross member can be realized regardless of the cross member segments. Theoretically then it is possible to already arrange all of the center girders of the bridging device on the cross member or a pair of cross members, respectively, so that the bridging device can be realized with a minimum number of cross members. According to the second alternative, the center girder(s) of the bridging devices in total are either arranged on a rodding segment or a guiding segment of the cross member. In this way, the problem of a possible height offset of the cross member segments can be evaded. Also, in this alternative a bridging device with a minimum number of cross members can be realized. For example, the cross member can be designed as an obliquely arranged pivoting cross member, so that a cross member segment can be formed particularly long, and on said long cross member segment already all center girders of the bridging device can be arranged.

In order to realize a uniform distribution of the center girders on the cross member also when the building components move in a further development at least one center girder is displaceably supported on the cross member at least toward the longitudinal axis thereof.

For a uniform distribution of the center girder on the cross member at least one center girder has a center girder bearing that allows a bearing of the center girder both above a guiding segment as well as a rodding segment at the same height. By this center girder bearing it is possible to compensate for possible differences in the design between the guiding segment and the rodding segment, for example a height offset. Moreover, it allows that center girder bearings can be displaced back and forth above the various cross member segments.

In a further development at least one center girder bearing is formed such that it only rests on one rodding segment or one guiding segment and does not touch an adjacent cross member segment. For example, the center girder bearing can be arranged on a guiding segment and can bridge an inserted rodding segment in a non-contacting manner, so that a change of the center girder bearing between various cross member segments is prevented. For that, the center girder bearing preferably has a U-shaped design.

In particular, in case of a guiding segment, that in a plan view is formed as a U-shaped clamp or an H-shaped double clamp, a preferably U-shaped center girder bearing can be used. Then, by means of the U-shaped center girder bearing a laterally enclosed rodding segment can be bridged in a non-contacting manner. In this way, the center girder bearing and the center girder, for example in case of narrow building joints, in an area can be pushed over the rodding segment. This even without the center girder bearing having to change the cross member segment. Further, a height offset between the cross member segments can be compensated or skipped, respectively.

According to a further development, at least one center girder has a center girder bearing that allows a rotational motion of the cross member below the center girder. In this way, on the one hand motions of the building components in different directions can be considered. On the other hand, it is possible to not only arrange the cross member perpendicular to the edge girders, but also as a pivoting cross member at an oblique angle.

In a further development, the cross member is obliquely arranged in the bridging device such that a change of the center girder(s) between a rodding segment and a guiding segment of the cross member is avoided. With an oblique arrangement, for example at an angle of 45°, it is also possible to arrange a cross member in the building joint that is particularly long in the retracted state. Now, motions of the building joint can be considered substantially with a relative small change in the length of the cross member by pivoting the cross member. Then, the cross member represents a pivoting cross member. The cross member segments have to be displaceable to each other only in very small extent in order to minimize unwanted transverse motions of the building components. Now, it is possible that also with a bridging device having several center girders all of these can already be arranged on a single cross member segment, since for that at least one cross member segment of the pivoting cross member can be formed sufficiently long. With said design as an obliquely arranged pivoting cross member having at least one particularly long cross member segment and a particularly small change in length of the cross member a change of the center girders is not necessary for a uniform distribution of several center girders along the longitudinal extension of the cross member and can be avoided. The bridging device thus can also be realized with a particularly small number of cross members.

In a further development, the pivoting cross member can also be formed as a pivoting cross member control device for controlling the distances of the center girders arranged on the cross member. For that, the center girders are rotatably attached to the cross member. But it is also conceivable to arrange other control devices, such as for example elastic chains, in order to control the distances of the center girders relative to each other.

For considering motions of the building components in different directions, for example in case of an earth quake, in a further development at least one cross member bearing, preferably both cross member bearings of the cross member is/are designed as spherical bearing, as depicted in FIG. 2A.

In a further development, the bridging device has several cross members that each are arranged spaced from each other and preferably in pairs in the bridging device. In this way, a particularly loadable bridging device can be provided, since the load can be distributed over several cross members and unfavorable levering effects are avoided. Such a bridging device is in particular suitable for relatively wide building joints.

According to a further development, adjacent cross members in a plane view are arranged substantially spaced in parallel and/or opposite to each other. In this way, a balanced load of the bridging devices is also possible if the center girders each are exclusively supported on the guiding segments of the cross member. Two outer guiding segments each can bridge an inserted rodding segment. In this way, also the initially described problems due to a height offset of the cross member segments can be evaded. Further, by the opposing arrangement an unwanted transversal motion of a bridging device with pivoting cross members can be prevented.

In order to be able to arrange center girders particularly easily at the same height in a further development one and/or more center girders is/are arranged on or attached to one single cross member segment or several similar cross member segments, in particular only on guiding segments. In this way, the problem that may result from a height offset or the differences in the design between the cross member segments is avoided. By limiting the arrangement of the center girders, for example only on guiding segments, the design of the rodding segment need not be considered for a flush orientation of the upper surfaces of the center girders, and vice versa.

According to a further development, at least one cross member bearing, preferably both cross member bearings of each cross member is/are designed such that the cross member(s) can rotate below the center girder(s), so that the cross member(s) act(s) as a pivoting cross member(s) and in particular as a pivoting cross member control device for controlling the distances between the center girder and the edge girders or between the center girders and the edge girders, respectively. In this way, it is particularly easy to realize uniform distances between the center girders.

But for controlling the distances between the center girders and the edge girders also springs or otherwise suitable alternative control devices can be arranged between the edge girders and the center girder(s) as a control device.

According to a further development, a center girder bearing or a cross member segment has at least one abutment for limiting the motion of a center girder on the cross member(s). Now, the motion of the center girder(s) can be limited to one cross member segment and there, in particular a change of the center girder(s) to another cross member segment can be avoided. In this way, the initially described problem that could result from a height offset or the differences in the design of the cross member segments can be avoided or evaded.

Between the center girder and the center girder bearing and/or between the center girder and the cross member(s) of the bridging device sliding surfaces may be formed. The bridging device can have at least one sliding material, in particular PTFE, UHMWPE, polyamide, and/or a multilayer sliding material. The at least one sliding material may be arranged at a center girder bearing and/or a center girder and/or a cross member of the bridging device. Preferably, at least one center girder bearing has a sliding material and acts as a sliding bearing.

BRIEF DESCRIPTION OF THE DRAWINGS

In the following, the invention is explained in detail with the help of the examples illustrated in the drawings. Here, by way of example.

In the figures the same reference symbols are used for similar parts.

DETAILED DESCRIPTION

Figure 1:
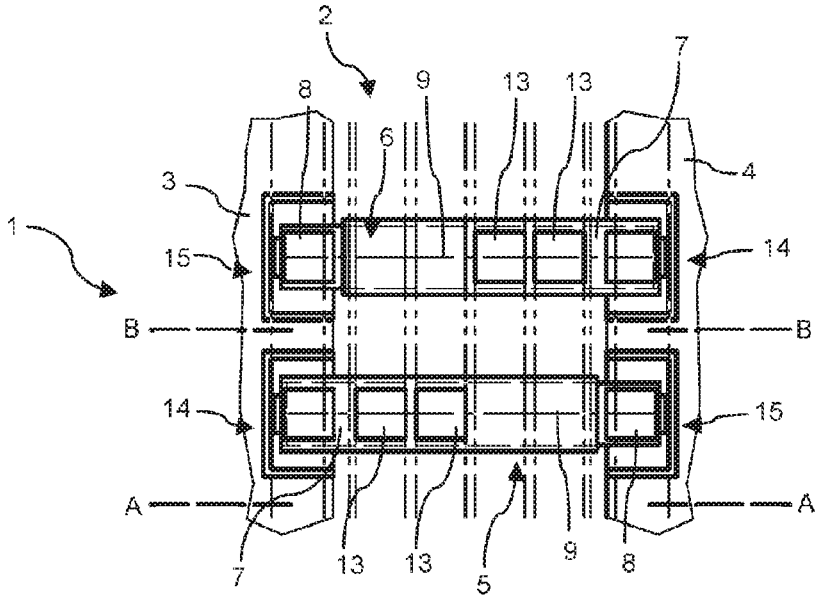
FIG. 1 shows a plan view of a part of a retracted bridging device according to a first embodiment.

In FIG. 1 to FIG. 7 a bridging device in center girder construction according to a first embodiment is illustrated. Bridging device 1, in an installation position, is arranged in a building joint 2 between two building components 3, 4. In the present case, bridging device 1 has two pairs of cross members 5, 6 bridging the building joint 2, cf. also FIG. 7. These cross members 5, 6 each have two cross member segments 7, 8 that are arranged along a longitudinal axis 9 of the cross members 5, 6 and that are arranged displaceable relative to each other toward the longitudinal axis 9, so that the length of cross members 5, 6 can be changed.

Here, one cross member segment each is formed as a guiding segment 7 and the other cross member segment as a rodding segment 8, wherein the guiding segment 7 guides the rodding segment 8 toward the longitudinal axis 9 of cross members 5, 6. Guiding segment 7 is formed as box section tubing, wherein the rodding segment 8 has a corresponding design and is supported such to be displaceable into the guiding segment 7. In the present case, the rodding segments 8 are substantially inserted into the guiding segments 7, so that the cross members 5, 6 have a relatively small length. FIG. 1 shows a first pair of cross members 5, 6 of the bridging device 1 in a retracted state. The two adjacent cross members 5, 6 in a plan view are arranged substantially spaced parallel and opposite to each other. Here, center girders 12 are indicated according to the broken lines, cf. FIG. 2.

Figure 2:
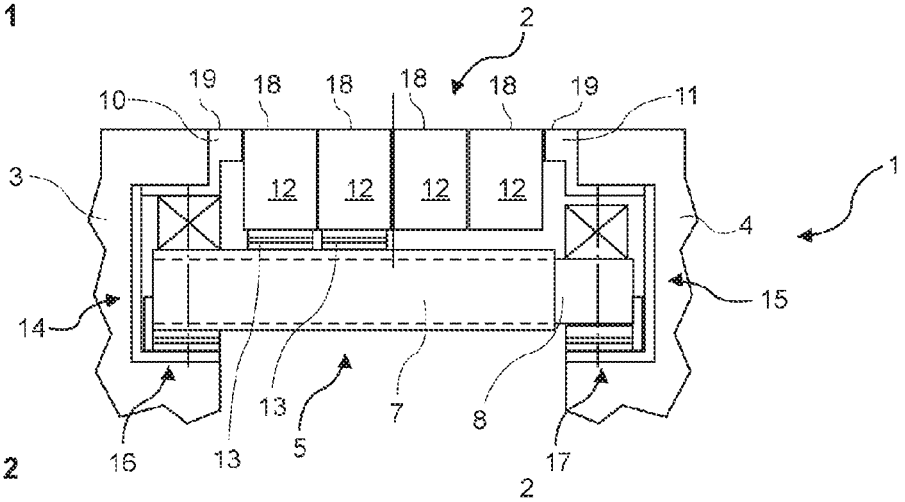
FIG. 2 shows a sectional view of the part shown in FIG. 1 according to sectional plane A-A.
Figure 2A:
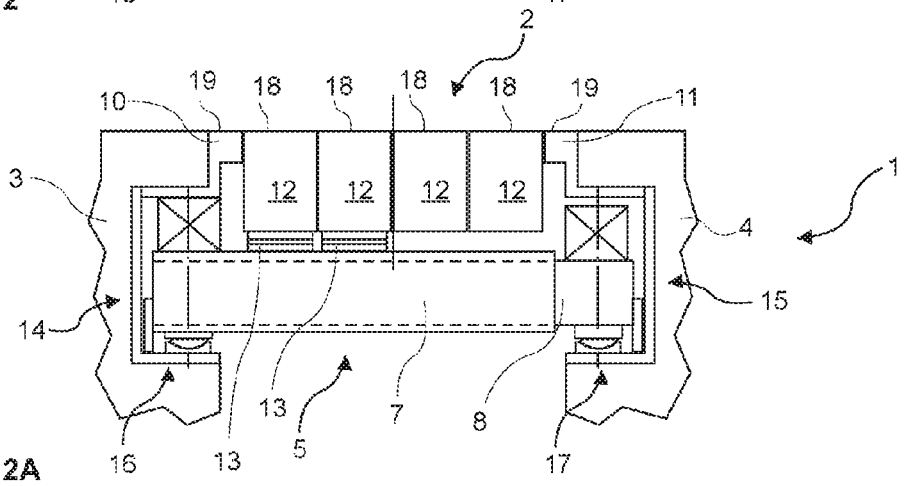
FIG. 2A shows a sectional view of an alternative embodiment of the part shown in FIG. 1 according to sectional plane A-A.

FIG. 2 shows that the bridging device 1 according to the first embodiment also has two edge girders 10, 11 that each are arranged on building components 3, 4 on the building. Between the edge girders 10, 11 and on the two pairs of cross members 5, 6 bridging the building joint 2 in the present case four center girders 12 are arranged. For that, between center girder 12 and guiding segments 7 on cross members 5, 6 two center girder bearings 13 each for two of the four center girders 12 each are arranged. The other two center girders 12 are not arranged on the cross member 5. At lateral ends 14, 15 of cross members 5, 6 the bridging device 1 has one cross member bearing 16, 17 each for bearing cross members 5, 6 on the respective building component 3, 4. Here, these cross member bearings 16, 17 each are arranged in cross member boxes on the respective building component 3, 4.

Figure 3:
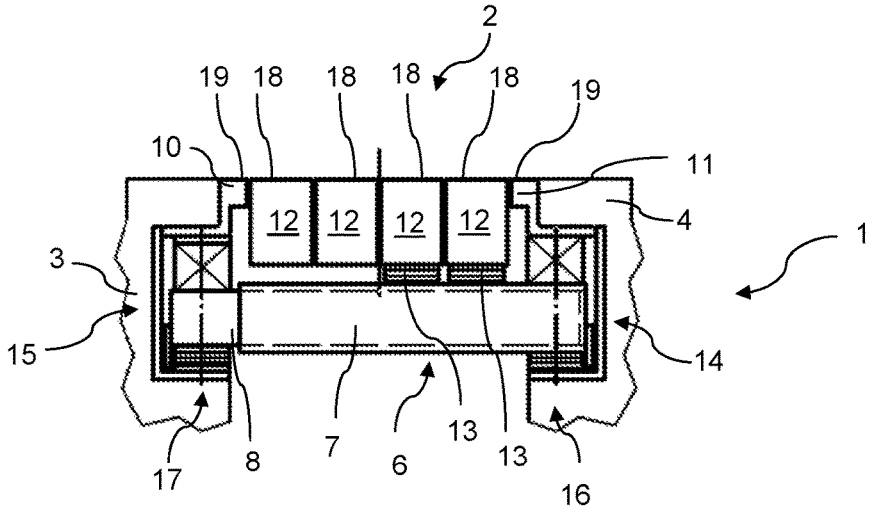
FIG. 3 shows a sectional view of the part shown in FIG. 1 according to sectional plane B-B.

In comparing FIGS. 2 and 3, that each illustrate cross members 5, 6 of the first pair of cross members 5, 6 of the bridging device 1 in detail, also the parallel spaced and opposite arrangement is apparent. While with the first cross member 5 illustrated in FIG. 2 the guiding segment 7 and the two center girder bearings 13 are arranged to the left and the rodding segment 8 is arranged to the right, with the second cross member 6 that is shown in FIG. 3 it is the other way.

Figure 4:
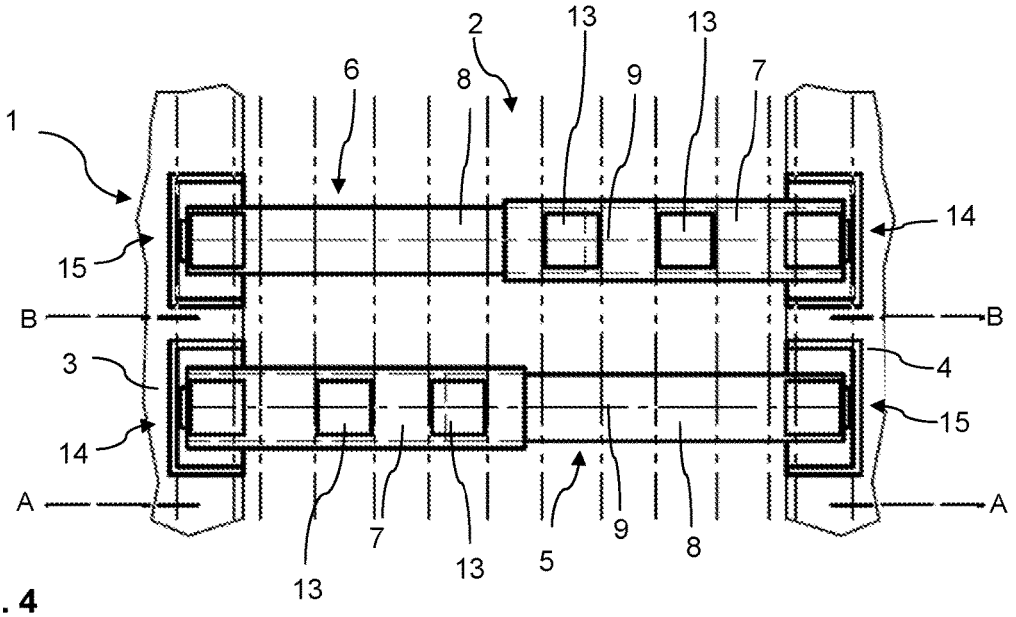
FIG. 4 shows a plan view of a part of an extended bridging device according to the first embodiment.

FIG. 4 shows the bridging device 1 according to the first embodiment with the building joint 2 open, i.e. in a wide-open position. Cross member segments 7, 8 are displaced such that cross members 5, 6 have a relatively large length. For that, rodding segments 8 are substantially pushed out of the guiding segments 7. That is, in other words, bridging device 1 is extended. The position of the center girders 12 is indicated by means of broken lines.

Figure 5:
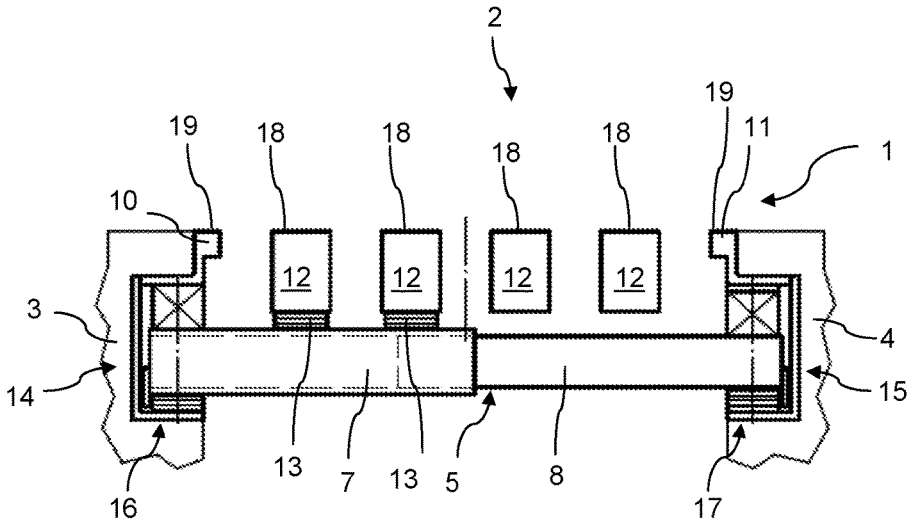
FIG. 5 shows a sectional view of the part shown in FIG. 4 according to sectional plane A-A.
Figure 6:
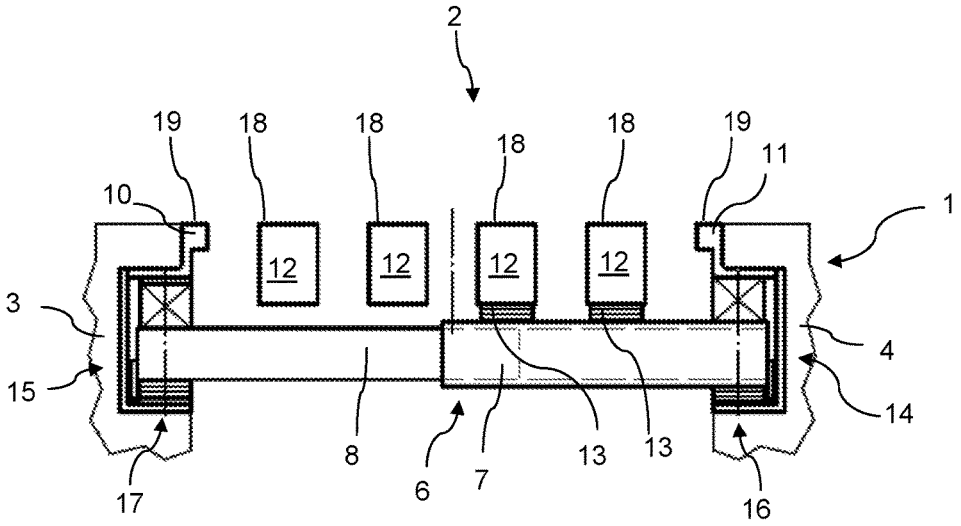
FIG. 6 shows a sectional view of the part shown in FIG. 4 according to sectional plane B-B.

FIG. 5 and FIG. 6 show that center girders 12 in this state are uniformly spaced relative to each other and to the edge girders 10, 11. For that, springs not illustrated in detail here are arranged between the edge girders 10, 11 and the center girders 12 as a control device for controlling the distances. As is apparent from FIGS. 5 and 6 the cross members 5, 6 and cross member segments 7, 8 and the controlling means are configured such that the center girders 12 also with extended cross members 5, 6 with rodding segments 8 that are substantially pushed out of the guiding segments 7 are exclusively arranged on the guiding segments 7. In this way, the upper surfaces 18 of the center girders 12 always are oriented flush with each other and also flush with the upper surfaces 19 of the edge girders 10, 11.

Figure 7:
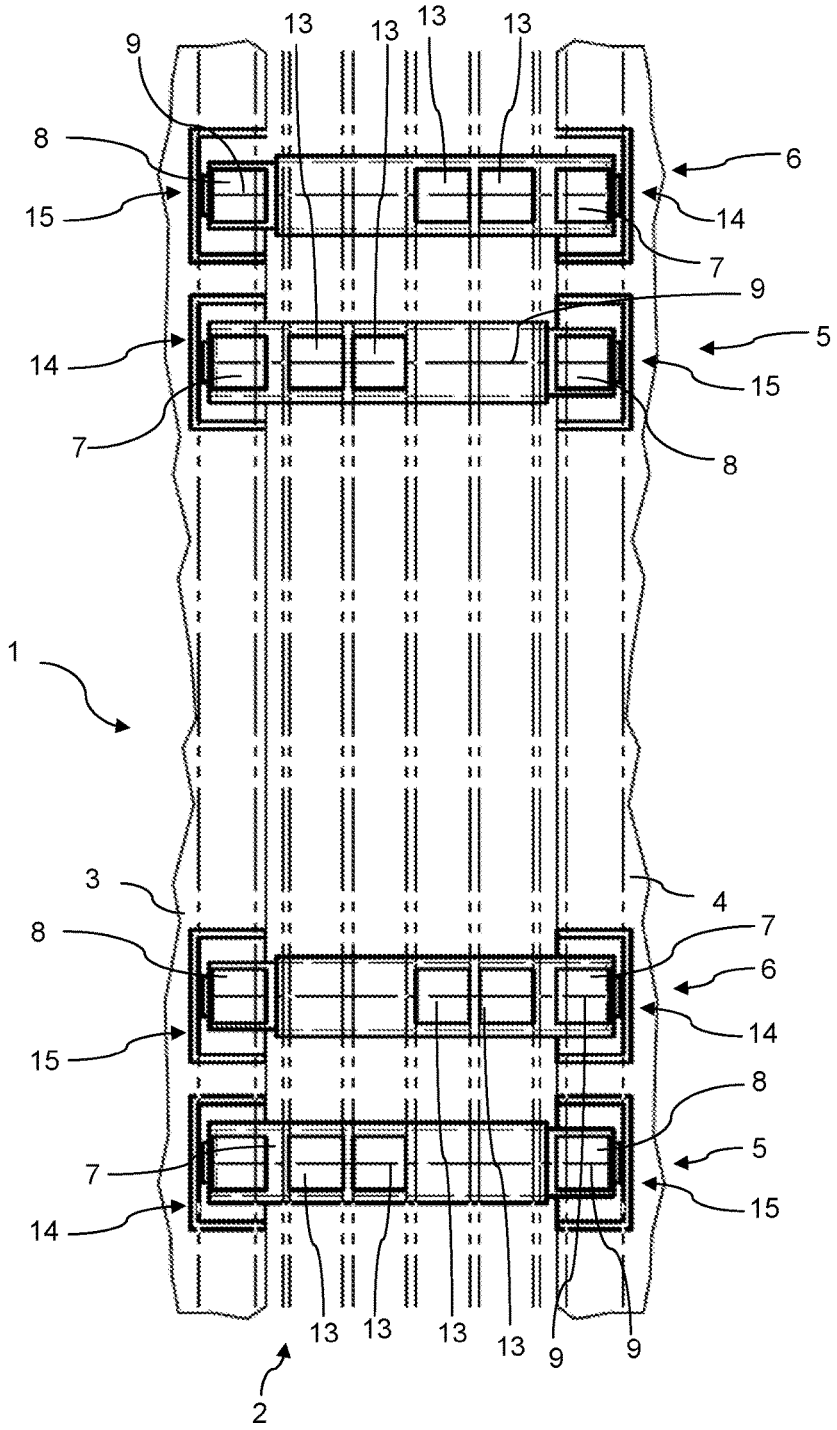
FIG. 7 shows a plan view of a retracted bridging device according to the first embodiment.

FIG. 7 shows a plan view of a retracted bridging device 1 according to the first embodiment as a whole. Bridging device 1 has two pairs of parallel spaced and opposite cross members 5, 6 according to FIG. 1. Here, two of the four center girders 12 each are arranged on the respectively identically formed and identically oriented cross members 5, 6 of the cross member pairs. Also here, center girders 12 are indicated by means of broken lines. The two left-handed center girders 12 each are arranged on two spaced cross members 5 formed according to FIG. 2, cf. FIGS. 2, 5, and 7. The opposite cross member 6 arranged in-between is not touched by the two left-handed center girders 12. The two right-handed center girders 12 each are arranged on two spaced cross members 6 formed according to FIG. 3, cf. FIGS. 3, 6, and 7. The opposite cross member 5 arranged in-between is not touched by the two left-handed center girders 12. All center girders 12 are exclusively arranged on the guiding segments 7 of the cross members 5, 6. If now the bridging device is extended, the center girders 12 arranged on respective two spaced guiding segments 7 bridge an inserted rodding segment 8 of an opposite cross member 5, 6. By the alternating orientation of the cross members 5, 6 a balanced load of the bridging devices 1 and a uniform distribution of the center girders 12 are achieved, even though the center girders 12 are exclusively arranged on the guiding segments 7. The initially described problems due to the height offset of the cross member segments 7, 8 are avoided.

Figure 8:
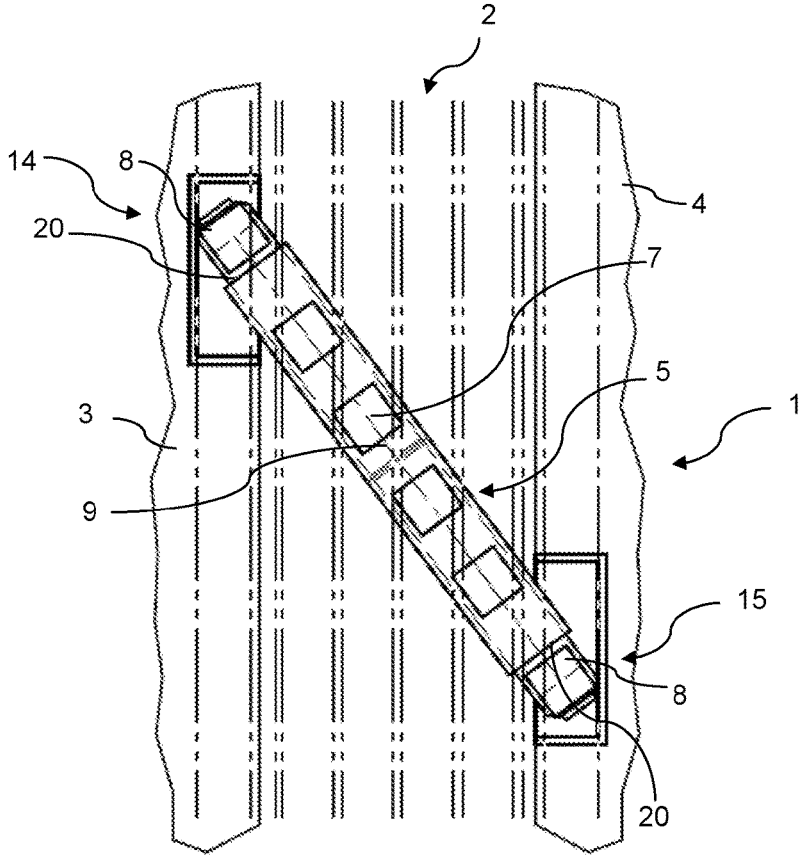
FIG. 8 shows a plan view of a part of a retracted bridging device according to a second embodiment.

In den FIGS. 8 to 12 a bridging device 1 according to a second embodiment is illustrated. FIG. 8 shows a first of the two cross members 5, 6 of the bridging device and that said first cross member 5 has three cross member segments 7, 8 and is obliquely arranged in the building joint 2. Cross member 5 represents a pivoting cross member. A central guiding segment 7 is formed as a box section tubing, wherein two corresponding rodding segments 8 project from the open front sides 20 of the central cross member segment 7 and are displaceable supported therein. FIG. 8 shows a retracted bridging device and cross member 5, respectively. Center girders 12 are only indicated by means of broken lines.

Figure 9:
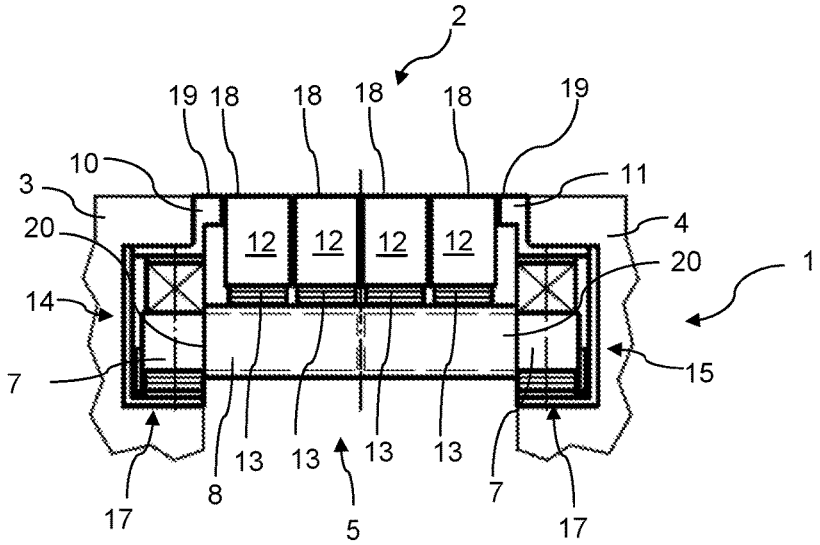
FIG. 9 shows a side view of the part according to FIG. 8 in a sectional view.

FIG. 9 shows that in the bridging device 1 according to the second embodiment four center girder bearings 13 for arranging the center girders 12 on the central guiding segment 7 are arranged. When the building gap is opened the cross member 5 pivots. Center girders 13 are formed such that they allow a rotational motion of the cross members 5 below the center girders 12. At the projecting ends 14, 15 of the rodding segments 8 each a cross member bearing 17 for bearing the cross member 5 on the respective building components 3, 4 is arranged. These cross member bearings 17 are configured such that cross member 5 can rotate under the center girders 12. Also upon pivoting the center girders 12 of cross member 5 remain on the central guiding segment 7. Moreover, a uniform distance between the center girders 12 is maintained. For that, cross member 5 can be formed as a pivoting cross member control device or can have springs.

Figure 10:
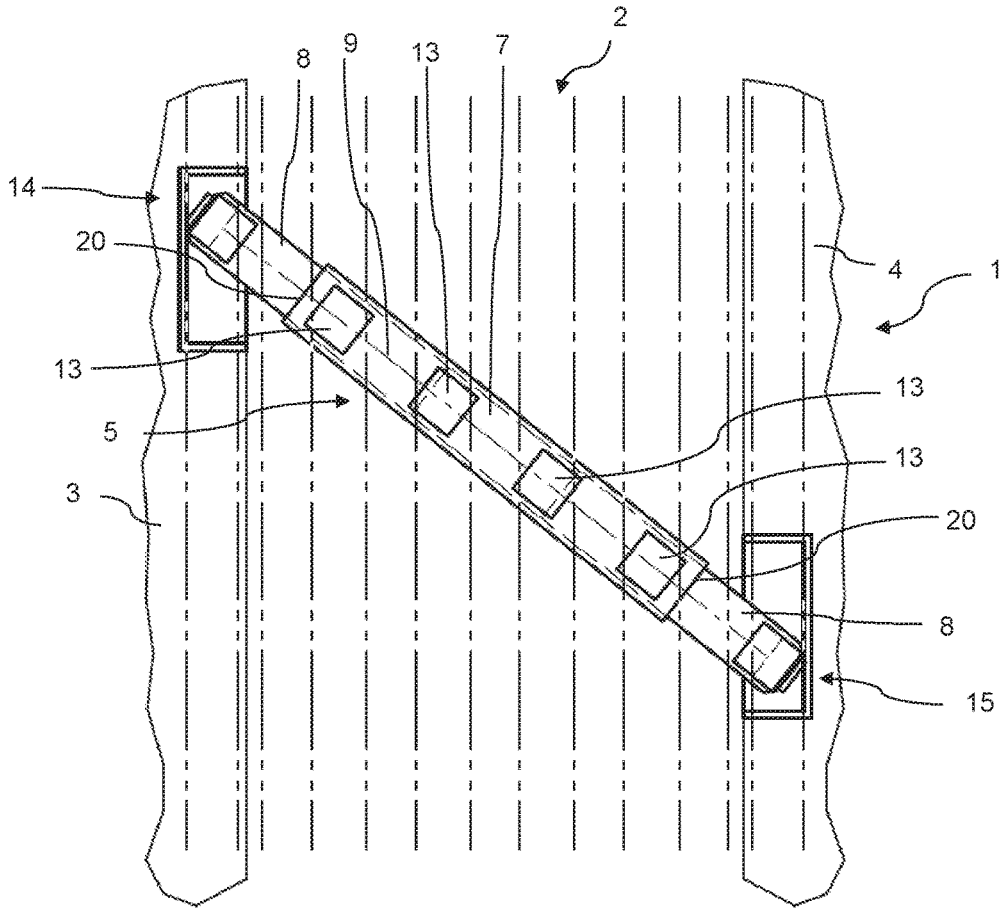
FIG. 10 shows a plan view of a part of an extended bridging device according to the second embodiment.

FIG. 10 shows the bridging device according to the second embodiment, wherein the building joint 2 is enlarged or opened, respectively, by motions of the building components 3, 4. In the enlarged building joint 2 cross member 5 is pivoted, moreover the two rodding segments 8 are pushed further out of the central guiding segment 7, so that cross member 5 has an increased length. That is, bridging device 1 is extended. The position of the center girders 12 is indicated by means of broken lines, cf. FIG. 11.

Figure 11:
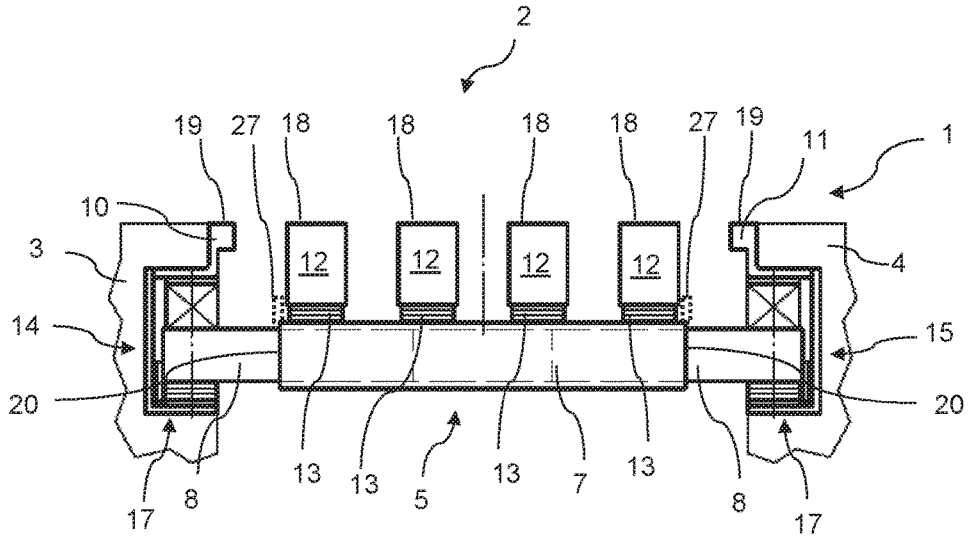
FIG. 11 shows a side view of the bridging device according to FIG. 10 in a sectional view.

FIG. 11 shows that the four center girders 12 are arranged uniformly spaced relative to each other and to the edge girders 10, 11. Cross member 5 is formed and obliquely arranged in the building joint 2 such that the center girders 12 and the center girders 13 do not change from one cross member segment 7, 8 to the other. In order to further secure the center girders 12, the center girder bearing 13 or a cross member segment 7, 8 can have at least one abutment 27.

Figure 12:
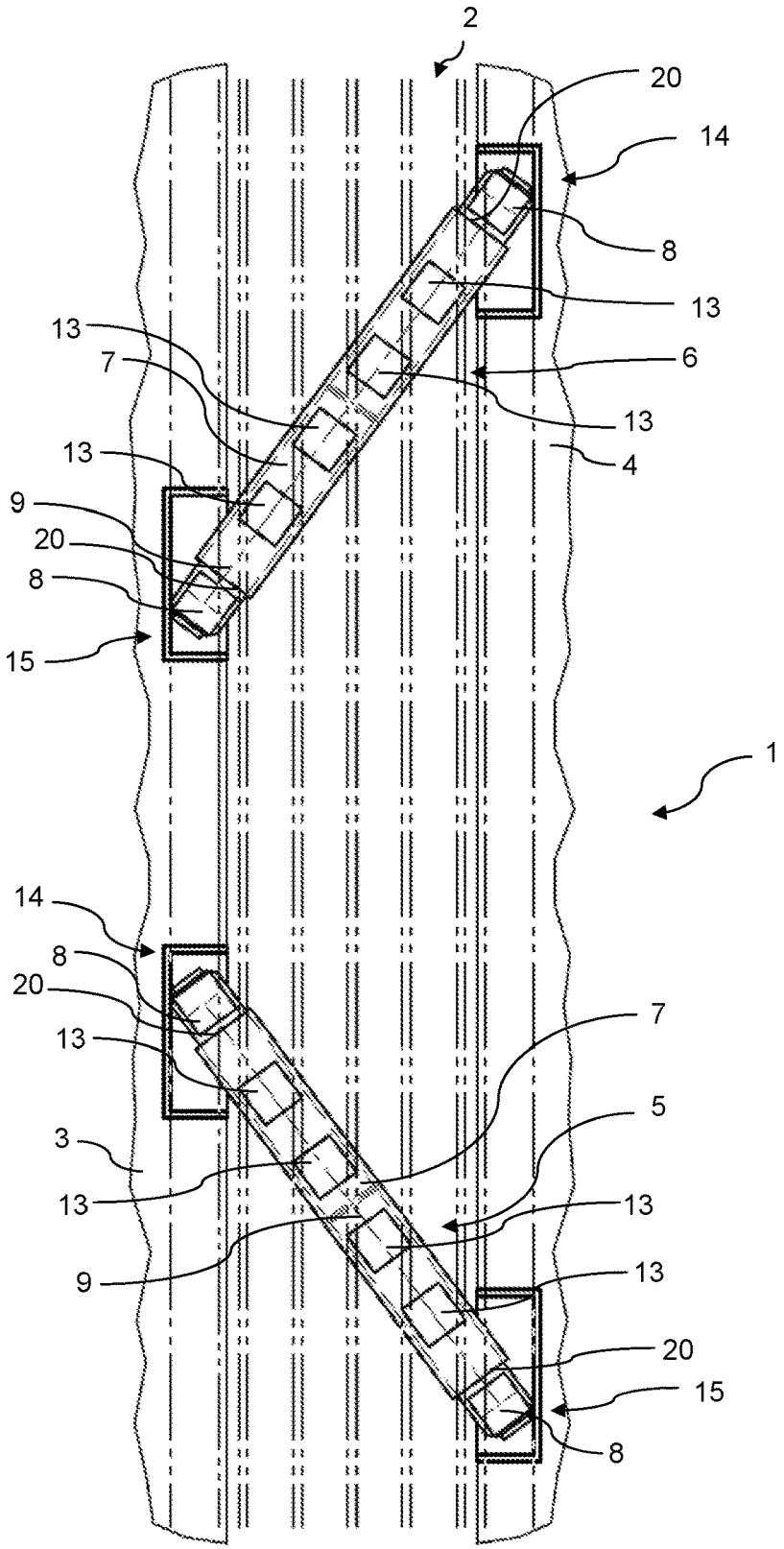
FIG. 12 shows a plan view of a retracted bridging device according to the second embodiment.

FIG. 12 shows a plan view of a retracted bridging device 1 according to the second embodiment as a whole. Bridging device 1, in addition to the first cross member 5 illustrated in FIG. 11, also has a further second cross member 6. This is spaced from the first one and differs from the first in that it is arranged opposite. In this way, a movement of the bridging device 1 transversally to the building components 3, 4 is avoided despite the oblique arrangement of the cross members 5, 6. Center girders 12 are indicated by broken lines.

Figure 13:
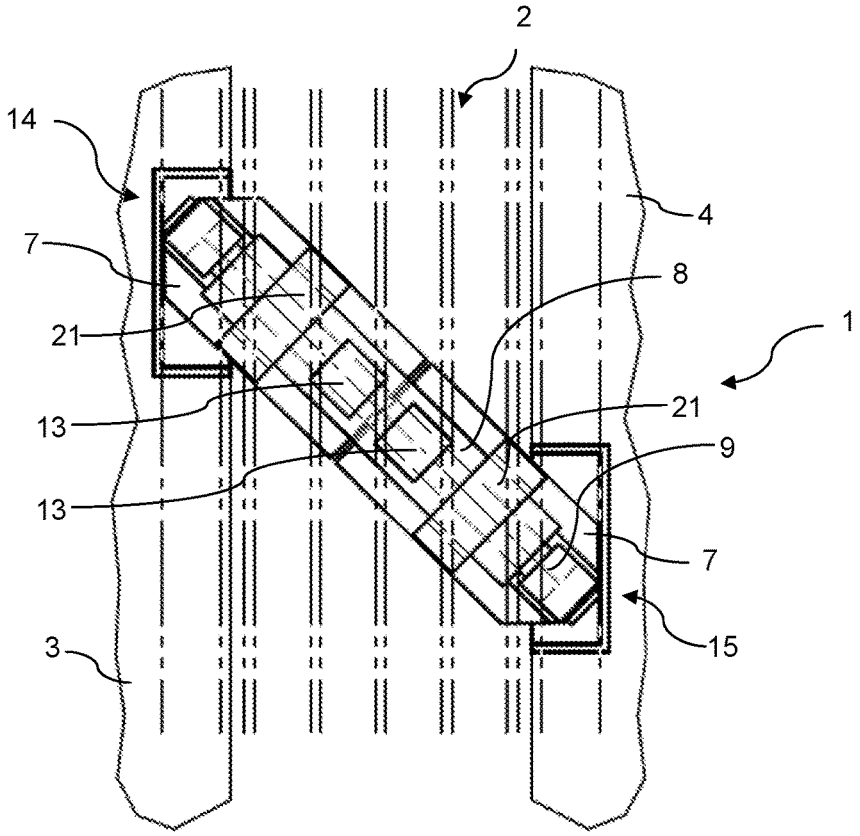
FIG. 13 shows a plan view of a part of a retracted bridging device according to a third embodiment.

FIGS. 13 to 17 show a bridging device 1 according to a third embodiment. This one differs from the second embodiment in that it has two cross members 5, 6 each having two outer guiding segments 7 that in the plan view are formed as U-shaped clamps and additionally a central rodding segment 8. Said rodding segment 8 has a corresponding double TT girder design. The first cross member 5 of the bridging device is illustrated in FIG. 13. Here, the center girders 12 are indicated by means of broken lines.

Two center girder bearings 13 are arranged on the central rodding segment 8. A U-shaped center girder bearing 21 is arranged on each of the two outer cross member segments 7. In this way, four center girders 12 are displaceably supported on the first cross member 5.

Figure 14:
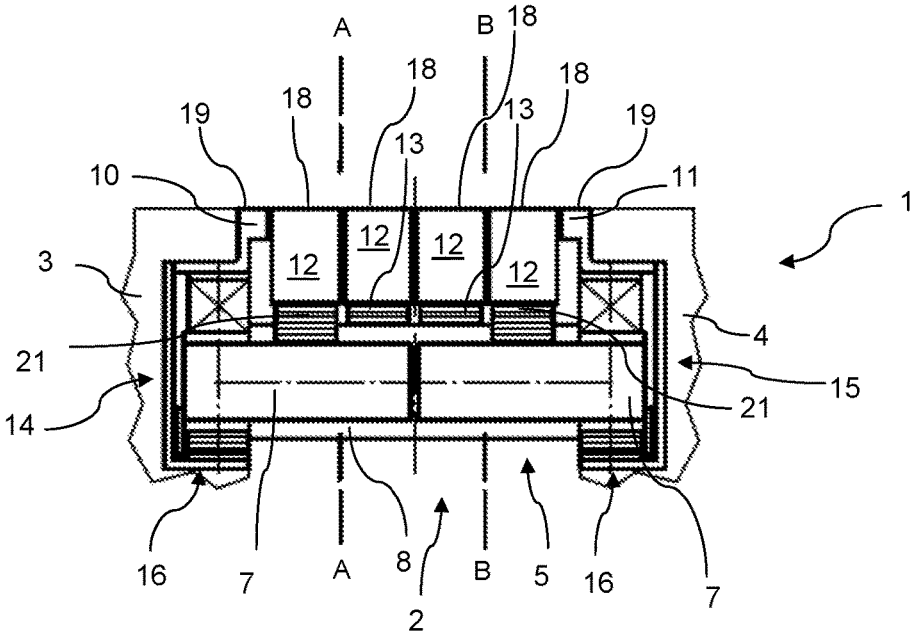
FIG. 14 shows a side view of the part according to FIG. 13.

FIG. 14 shows that the U-shaped center girder bearings 21 to a certain extend bridge the central cross member segment 8. That's why said center girder bearing 21 can remain arranged on the guiding segment 7 even though it should change from one cross member segment 7, 8 to the next. Cross member bearings 16 are arranged at external ends 14, 15 of the cross member 5 that allow a rotational motion of the cross member 5. If now said cross member 5 is pivoted a uniform distance between the center girders 12 is maintained. For that, cross member 5 can be formed as a pivoting cross member control device or can have springs. It is also possible to perpendicularly arrange cross member 5 in the building joint 2.

As shown in FIG. 13 and FIG. 14, in case of a relatively small and closed building joint 2, respectively, the outer cross member segments 7 of the first cross member 5 of the bridging device 1 are pushed to each other and laterally surround the central cross member segment 8. In this way, cross member 5 has a relatively small longitudinal extension that substantially results from the sum of the lengths of the outer cross member segments 7. Bridging device 1 is retracted.

Figure 15:
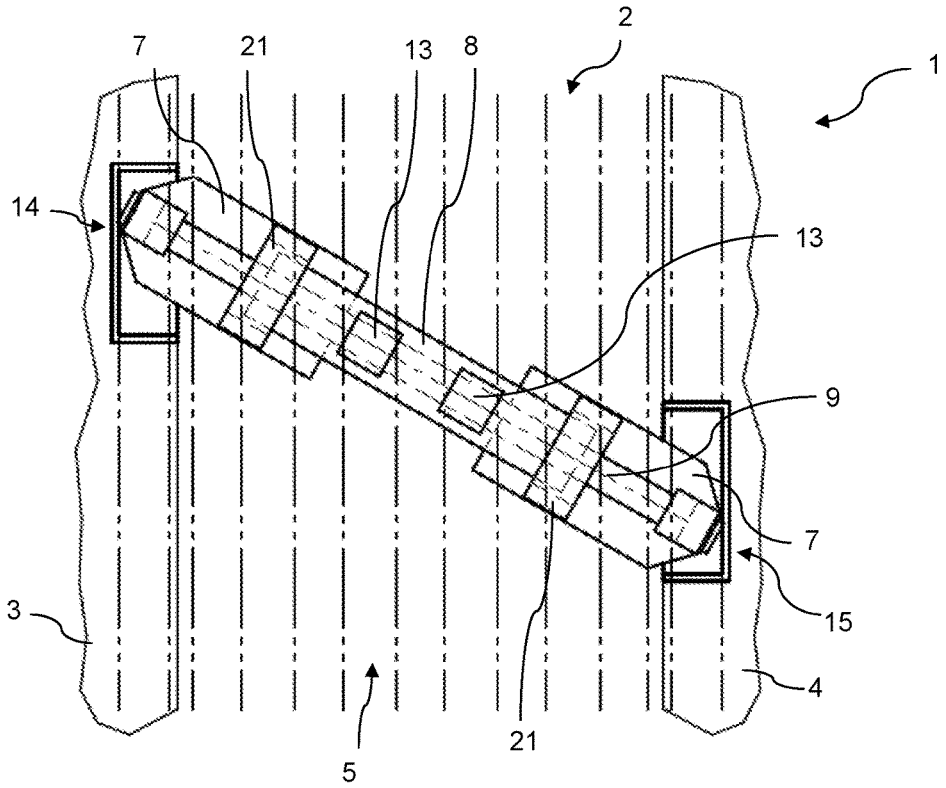
FIG. 15 shows a plan view of a part of an extended bridging device according to the third embodiment.
Figure 16:
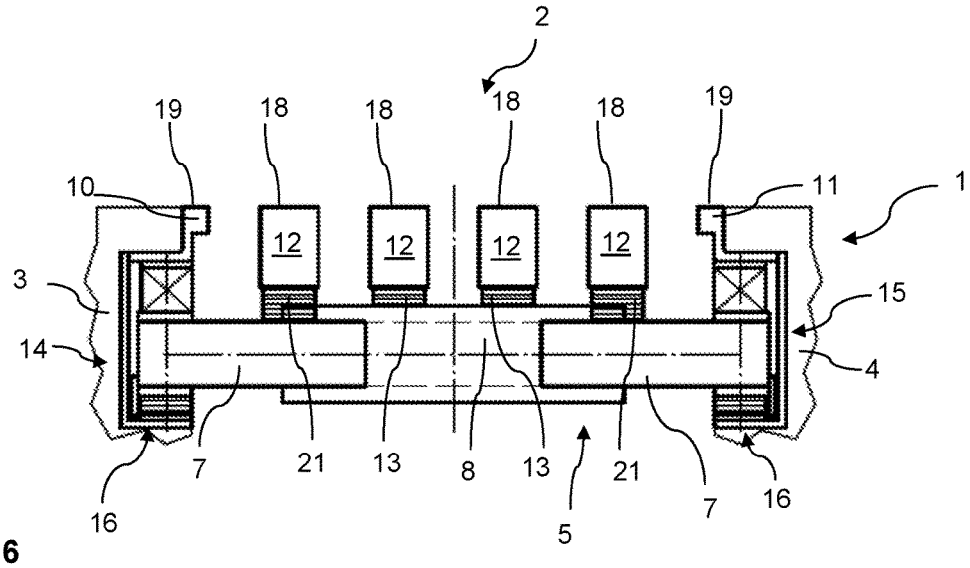
FIG. 16 shows a side view of the part according to FIG. 15 in a sectional view.

FIGS. 15 and 16 show the bridging device 1 according to the third embodiment in the open state. In case of the open building joint 2, cross member 5 is pivoted. Furthermore, the longitudinal extension of cross member 5 is increased in that the central rodding segment 8 is substantially pushed out of the two outer guiding segments 7. Bridging device 1 is extended. In FIG. 15, center girders 12 are indicated by broken lines.

It is apparent from FIG. 16 that center girders 12 are uniformly spaced relative to each other and relative to the edge girders 10, 11. By the differently formed center girder bearings 13, 21 the center girders 12 both above the guiding segments 7 and the central rodding segment 8 are supported at the same height. Center girder bearings 21 that are arranged on the two outer center girders 12 are formed such that respective center girder bearing 21 only rests on one assigned guiding segment 7 and does not touch the adjacent central rodding segment 8. For that, these center girder bearings 12 preferably have a U-shaped design. These center girder bearings 21 allow that the assigned center girders 12 can be moved back and forth on cross member 5 at least partially between the cross member segments 7, 8, cf. FIG. 14.

Figure 17:
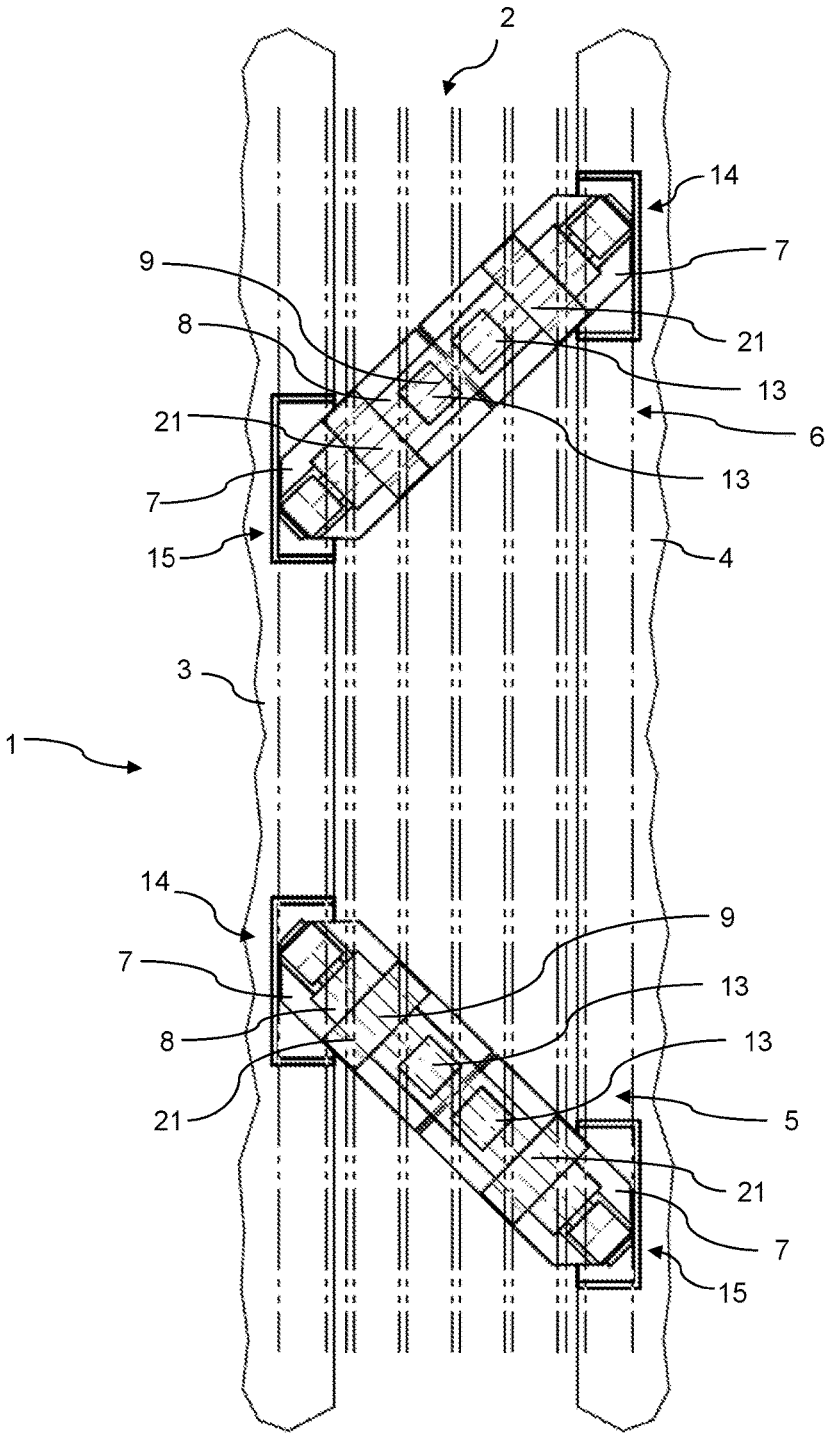
FIG. 17 shows a plan view of a retracted bridging device according to the third embodiment.

FIG. 17 shows a plan view of a retracted bridging device 1 according to the third embodiment as a whole. Bridging device 1, in addition to the first cross member 5 illustrated in FIG. 13, also has a further second spaced cross member 6. This differs from the first one only in that it is arranged opposite. An unwanted transverse motion of the bridging device 1 to the building components 3, 4 is avoided by the opposite arrangement of the cross members 5, 6. Here, center girders 12 are indicated by means of broken lines.

Figure 18:
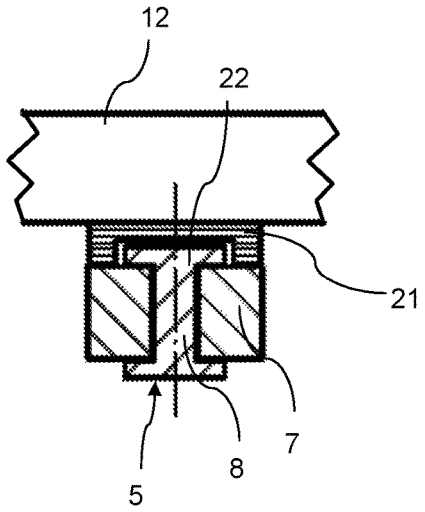
FIG. 18 shows a sectional view of sectional plane A-A illustrated in FIG. 13.

FIG. 18 shows in detail how a center girder 12 is supported on a guiding segment 7 of the first cross member 5 according to the third embodiment. So, a U-shaped center girder bearing 21 is arranged between the center girder 12 and the guiding segment 7. The U-shaped center girder bearing 21 is formed such that it bridges a segment area 22 of a rodding segment 8 enclosed into the guiding segment 7 that projects beyond the upper surface of the guiding segment 7 in a non-contacting manner.

Figure 19:
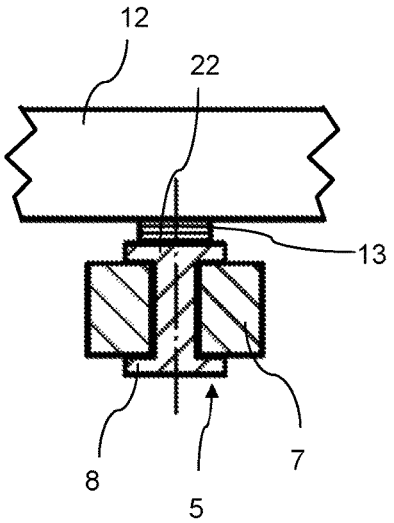
FIG. 19 shows a sectional view of sectional plane B-B illustrated in FIG. 13.

FIG. 19 shows how a center girder 12 is supported on a central rodding segment 8 of the first cross member 5 according to the third embodiment. For that, a center girder bearing 13 arranged in-between is arranged between the center girder 12 and the guiding segment 8.

Figure 20:
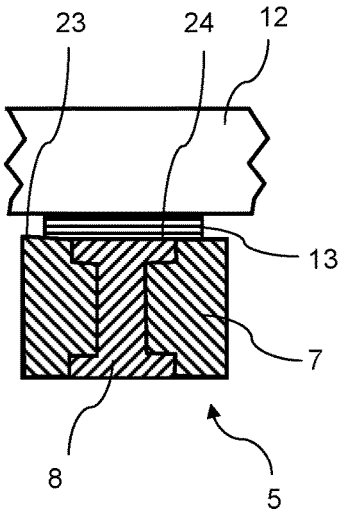
FIG. 20 shows a side view of a first alternative embodiment of a cross member of a bridging device in a sectional view.
Figure 21:
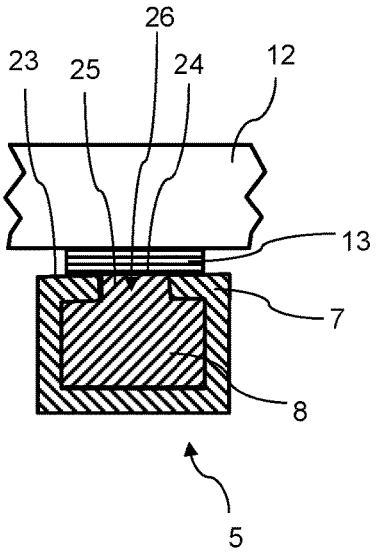
FIG. 21 shows a side view of a second alternative embodiment of a cross member of a bridging device.

FIGS. 20 and 21 show variants of cross member 5. Here, FIG. 20 shows a first variant of cross member 5 that differs from the first cross member 5 of the third embodiment of the bridging device in that guiding segment(s) 7 are formed correspondingly with respect to the rodding segment 8 such that the upper surfaces 23, 24 of the various cross member segments 7, 8 of cross member 5 are oriented flush with each other. In this way, a height offset is prevented. For bearing the center girders 12 on the various cross member segments 7, 8 one center girder bearing 13 each is arranged between the cross member 5 and the center girder 12. Cross member 5 allows a displaceable bearing of the center girders 12 without different center girder bearings both on a guiding segment 7 as well as on a rodding segment 8.

FIG. 21 shows a further variant of cross member 5. This is formed identical to the cross members 5, 6 of the first and second embodiment of the bridging device 1. Moreover, rodding segment 8 has a tongue 25 that engages an upper groove 26 of the respective guiding segment 7 such that the upper surfaces 23, 24 of the various cross member segments 7, 8 of cross member 5 are oriented flush with each other. Between the center girder 12 and cross member 5 a center girder bearing 13 is arranged. Said alternative also allows a displaceable bearing of the center girders 12 without different center girder bearings both on a guiding segment 7 as well as on a rodding segment 8.

REFERENCE NUMBERS bridging device 1
building joint 2
building component 3
building component 4
cross member 5
cross member 6
guiding segment 7
rodding segment 8 longitudinal axis 9
edge girder 10
edge girder 11
center girder 12
center girder bearing 13
end 14
end 15
cross member bearing 16
cross member bearing 17
upper surface 18
upper surface 19
front side 20
center girder bearing 21
segment area 22
upper surface 23
upper surface 24
tongue 25
groove 26

The invention claimed is:

1. A bridging device for a building joint between two building components, the bridging device comprising:

at least two edge girders;

at least one center girder arranged between the at least two edge girders; and at least one cross member bridging the building joint, each of the at least one cross member having a cross member bearing for bearing lateral ends of the at least one cross member on the respective building components, wherein each of the at least one cross member has at least two cross member segments arranged along a length of the at least one cross member, the at least two cross member segments being displaceable relative to each other, such that the length of the at least one cross member is variable, wherein the cross member bearings allow pivotal movement between the at least one cross member and the edge girders which rest thereon.

2. The bridging device according to claim 1, wherein at least one of the at least two cross member segments includes a guiding segment and a rodding segment, and the guiding segment guides the rodding segment along a longitudinal axis of the at least one cross member.

3. The bridging device according to claim 2, wherein the guiding segment includes a tube in which the rodding segment is displaceably received.

4. The bridging device according to claim 2, wherein the guiding segment has at least one tongue that extends parallel to the longitudinal axis of at least one the cross member and that engages a groove in the rodding segment.

5. The bridging device according to claim 2, wherein the guiding segment includes a U-shaped clamp or an H-shaped double clamp, the guiding segment laterally enclosing the rodding segment and holding the rodding segment transversally to the longitudinal axis of the at least one cross member.

6. The bridging device according to claim 2, wherein the rodding segment is formed as a massive and/or hollow girder.

7. The bridging device according to claim 6, wherein the rodding section includes a T girder, double T girder, or a box section tubing.

8. The bridging device according to claim 1, wherein the at least one center girder comprises at least two center girders having upper surfaces oriented flush with each other.

9. The bridging device according to claim 1, wherein the at least one center girder is arranged on a guiding segment and/or a rodding segment of the at least one cross member.

10. The bridging device according to claim 1, wherein the at least one center girder is supported on the at least one cross member toward a longitudinal axis of the at least one cross member.

11. The bridging device according to claim 1, wherein the at least one center girder has a center girder bearing that allows bearing of the at least one center girder both above a guiding segment and a rodding segment at the same height.

12. The bridging device according to claim 11, wherein the at least one center girder bearing only rests on one rodding segment or one guiding segment and does not touch an adjacent cross member segment.

13. The bridging device according to claim 12, wherein the at least one center girder bearing has a U-shaped design.

14. The bridging device according to claim 1, wherein the at least one center girder has a center girder bearing that allows rotational motion of the at least one cross member below the at least one center girder.

15. The bridging device according to claim 1, wherein the at least one cross member is obliquely arranged in the bridging device.

16. The bridging device according to claim 1, wherein at least one of the cross member bearings comprises a spherical bearing.

17. The bridging device according to claim 1, wherein the at least one cross member comprises a plurality of cross members spaced from each other.

18. The bridging device according to claim 17, wherein adjacent cross members of the plurality of cross members are arranged substantially spaced in parallel.

19. The bridging device according to claim 17, wherein cross members of the plurality of cross members are arranged in pairs.

20. The bridging device according to claim 1, wherein the at least one center girder is attached on a single cross member segment.

21. The bridging device according to claim 1, wherein the at least one cross member is configured to rotate under the at least one center girder to control distances between the at least one center girder and the at least two edge girders.

22. The bridging device according to claim 1, further comprising a control device comprising springs arranged between the at least two edge girders and the at least one center girder, the control device being configured to control a distance between the at least one center girder and the at least two edge girders.

23. The bridging device according to claim 1, wherein a center girder bearing or at least one of the cross member segments has at least one abutment for limiting the movement of the at least one center girder on the at least one cross member.

24. The bridging device according to claim 1, wherein the at least one center girder is attached only on guiding segments.

* * * * *